US012790802B1

(12) United States Patent
Heard Andrews

(10) Patent No.: US 12,790,802 B1
(45) Date of Patent: Nov. 10, 2026

(54) SMART TUB AND INTELLIGENT VALVE PLUMBING SYSTEM

(71) Applicant: Tina Heard Andrews, Tracy, CA (US)

(72) Inventor: Tina Heard Andrews, Tracy, CA (US)

(73) Assignee: Tina Heard Andrews, Tracy, CA (US)

( * ) Notice: Subject to any disclaimer, the term of this patent is extended or adjusted under 35 U.S.C. 154(b) by 0 days.

(21) Appl. No.: 19/065,806

(22) Filed: Feb. 27, 2025

Related U.S. Application Data

(60) Provisional application No. 63/574,115, filed on Apr. 3, 2024.

(51) Int. Cl.
*E03C 1/05* (2006.01)

(52) U.S. Cl.
CPC ..... *E03C 1/057* (2013.01); *Y10T 137/9464* (2015.04)

(58) Field of Classification Search
CPC . E03C 1/04; E03C 1/046; E03C 1/055; E03C 1/057; E03C 2001/40; Y10T 137/9464
USPC ..... 137/801
See application file for complete search history.

(56) References Cited

U.S. PATENT DOCUMENTS 11,459,739 B2 * 10/2022 Chaky ..... E03C 1/055
12,138,356 B2 * 11/2024 Smith ..... G01N 21/94
2011/0186154 A1 * 8/2011 Klicpera ..... E03C 1/055 137/551
2013/0175350 A1 * 7/2013 Marks ..... G05D 23/1393 236/12.12
2015/0224525 A1 * 8/2015 Klicpera ..... E03C 1/04 4/615
2018/0016773 A1 * 1/2018 Chandler ..... E03C 1/0404
2019/0089550 A1 * 3/2019 Rexach ..... A47K 5/1217
2020/0354932 A1 * 11/2020 Gunawardena ..... G10L 15/22

* cited by examiner

*Primary Examiner* — Daphne M Barry
(74) *Attorney, Agent, or Firm* — Stephen Hallberg; Michael L. Schack; PLAGER Schack LLP

(57) ABSTRACT

A smart tub and intelligent valve plumbing system is disclosed which is used to fill a tub with water and automatically set the temperature of the water and release a solution into the water by wireless control. The smart tub and intelligent valve plumbing system is designed to operate by manual control on site or by wireless control remotely by a mobile device with a mobile app (software). Manually controlling the intelligent valve on site overrides wireless functioning. The smart tub includes connected hot and cold water hoses which allows the smart tub and intelligent valve plumbing system to set the temperature of the water as specified in the mobile app. Furthermore, the smart tub and intelligent valve plumbing system controls the time of filling the tub and the time of releasing the tub's solution dispenser, which is a battery-operated dispenser configured to release an amount of solution into the water.

14 Claims, 3 Drawing Sheets

SMART TUB AND INTELLIGENT VALVE PLUMBING SYSTEM

This application claims benefit to United States Provisional Patent Application 63/574,115, entitled "smart tub and intelligent valve plumbing system," filed Apr. 3, 2024. The U.S. Provisional Patent Application 63/574,115 is incorporated herein by reference.

BACKGROUND

Embodiments of the invention described in this specification relate generally to water basin ("tub") plumbing systems, and more particularly, to a smart tub and intelligent valve plumbing system configured to fill a tub with water and automatically set the temperature of the water and release a solution into the water by wireless control.

Many people spend all day out and about, at work, or doing other things that stress them out during the day. It is common for them to come home stressed out. However, coming home stressed or even being busy in the home all day with chores or kids, it is understandable that people would need some pampering. However, this is normally just another task to complete by the already stressed out individual.

Therefore, what is needed is a way to automatically prepare a soothing bath for a stressed out individual, or an individual in any mental state who needs pampering, which sets temperature as desired and automatically releases bath solutions into the water as desired, while timing the filling of the tub to coincide approximately with the arrival of the individual at home and without overfilling the tub.

BRIEF DESCRIPTION

A novel smart tub and intelligent valve plumbing system is disclosed. In some embodiments, the smart tub and intelligent valve plumbing system is configured to automatically fill a tub with water at a scheduled day and time, automatically set the temperature of the water, and automatically release a solution into the water. In some embodiments, the smart tub and intelligent valve plumbing system triggers the automated functions of filling the tub at the scheduled day and time, setting the temperature of the water, and releasing the solution into the water by way of program parameters manually set by a user set by ("manual control") through a control panel at the site of the tub or by through a mobile application ("app") that runs on a mobile device operable by the user for remote setting ("remote control") of program parameters.

In some embodiments, the smart tub and intelligent valve plumbing system comprises a smart water basin ("tub"), a faucet, a printed circuit board (PCB) control unit ("PCB controller"), a housing that encapsulates the PCB controller, a cold water handle connected to a cold water source hose, a hot water handle connected to a hot water source hose, an intelligent water control valve ("intelligent valve" or "intel valve") that is configured to adjust a volume of cold water released through the cold water source hose and a volume of hot water released through the hot water source hose, a plurality of solution dispensers, a runoff drain, and a drain sensor within the runoff drain. In some embodiments, the faucet is configured to release temperature-adjusted water into the tub until the drain sensor detects water flow out of the tub through the runoff drain. In some embodiments, the plurality of solution dispensers are configured to release solution into the tub as the faucet fills the tub with temperature-adjusted water.

In some embodiments, the PCB controller comprises a wireless communications module. In some embodiments, a control panel is communicably connected to the PCB controller and exposed along an external surface of the housing. In some embodiments, the program parameters comprise a water temperature setting, a solution mixture setting, a solution timer setting, and a schedule day and time setting at which a tub of water should be filled at the set temperature and with the solution mixture added to the water. In some embodiments, the control panel enables a user to manually control the water temperature setting, the solution mixture setting, the solution timer setting, and the schedule day and time setting.

In some embodiments, the wireless communications module is configured to receive wireless commands transmitted by the mobile app via Wifi, Bluetooth, or any other wireless transmission protocol. In some embodiments, the wireless communications module passes the received commands to the PCB controller. In some embodiments, the PCB controller automatically triggers the faucet to release water into the tub. In some embodiments, the PCB controller automatically triggers the intelligent valve to adjust a volume of hot water to release from the hot water source hose connected to the hot water handle and the volume of cold water to release from the cold water source hose connected to the cold water handle. In some embodiments, the mobile app includes a user interface that is configured for user interaction to set the program parameters and wirelessly operate the smart tub and intelligent valve plumbing system.

In some embodiments, manually controlling the intelligent valve on site, via the control panel, overrides wireless functioning at the moment of manual manipulation. In some embodiments, the smart tub includes connected hot and cold water hoses which allow the smart tub and intelligent valve plumbing system to set the temperature of the water as desired. Furthermore, the smart tub and intelligent valve plumbing system of some embodiments controls the time of filling the tub and the time of releasing the tub's solution dispenser, which is a battery-operated dispenser configured to release an amount of solution into the water. In particular, the battery-operated dispenser is configured to release only the desired amount of solution into the water. In some embodiments, the battery-operated dispenser automatically detects a safe amount of solution to dispense so as not to overflow the tub when released into the water.

The preceding Summary is intended to serve as a brief introduction to some embodiments of the invention. It is not meant to be an introduction or overview of all inventive subject matter disclosed in this specification. The Detailed Description that follows and the Drawings that are referred to in the Detailed Description will further describe the embodiments described in the Summary as well as other embodiments. Accordingly, to understand all the embodiments described by this document, a full review of the Summary, Detailed Description, and Drawings is needed. Moreover, the claimed subject matters are not to be limited by the illustrative details in the Summary, Detailed Description, and Drawings, but rather are to be defined by the appended claims, because the claimed subject matter can be embodied in other specific forms without departing from the spirit of the subject matter.

BRIEF DESCRIPTION OF THE DRAWINGS

Having described the invention in general terms, reference is now made to the accompanying drawings, which are not necessarily drawn to scale, and wherein.

DETAILED DESCRIPTION

Figure 1:
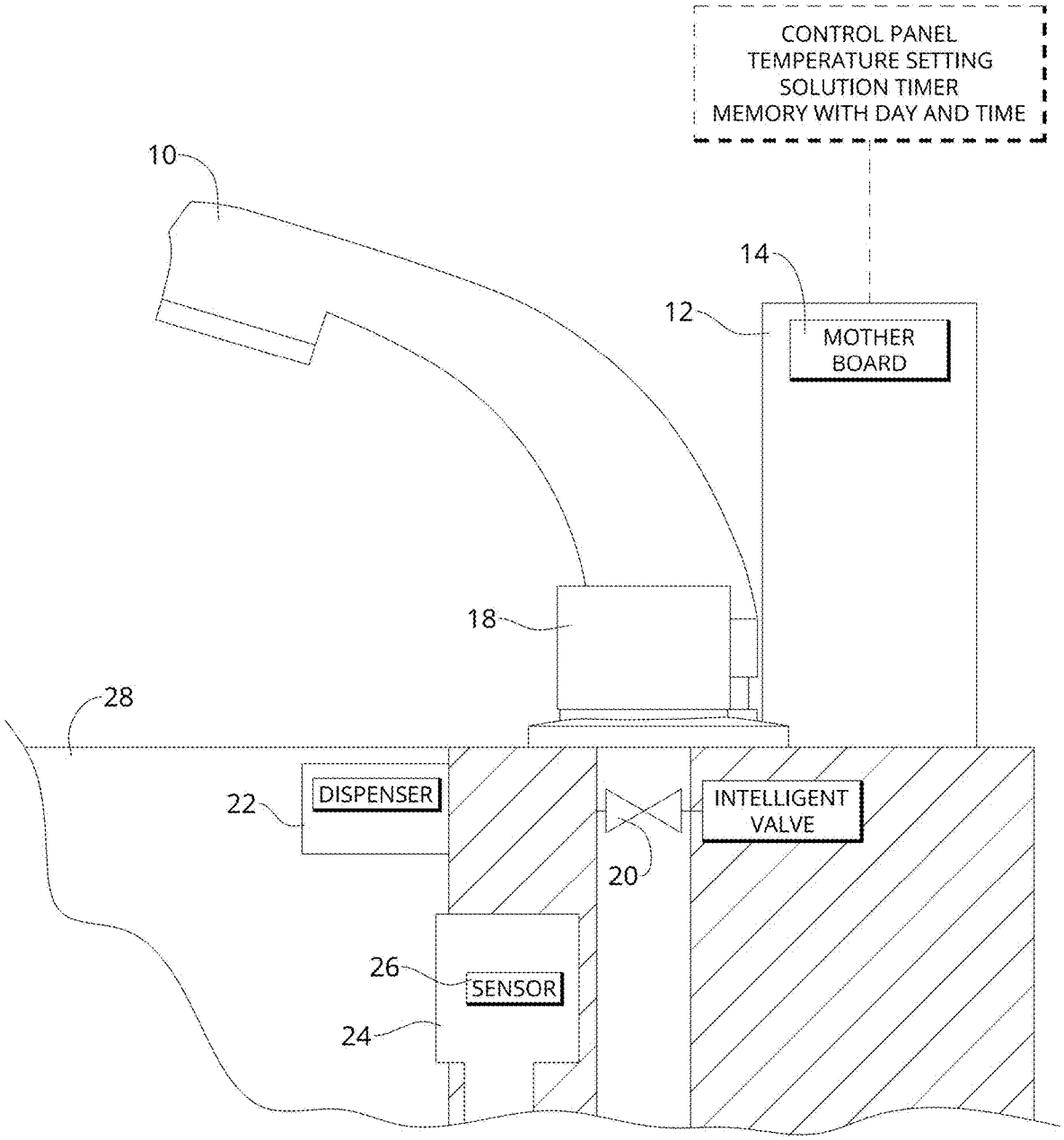
FIG. 1 conceptually illustrates a schematic view of a smart tub and intelligent valve plumbing system plumbing system in some embodiments.

In the following detailed description of the invention, numerous details, examples, and embodiments of the invention are described. However, it will be clear and apparent to one skilled in the art that the invention is not limited to the embodiments set forth and that the invention can be adapted for any of several applications.

Embodiments of the invention described in this specification include a smart tub and intelligent valve plumbing system that is configured to fill a tub with water at a set time, automatically set the temperature of the water, and release a solution into the water by wireless control. In short, the smart tub and intelligent valve plumbing system provides convenience in the home and cuts back on time and helps lower stress.

In some embodiments, the smart tub and intelligent valve plumbing system is configured to automatically fill a tub with water at a scheduled day and time, automatically set the temperature of the water, and automatically release a solution into the water. In some embodiments, the smart tub and intelligent valve plumbing system triggers the automated functions of filling the tub at the scheduled day and time, setting the temperature of the water, and releasing the solution into the water by way of program parameters manually set by a user set by ("manual control") through a control panel at the site of the tub or by through a mobile application ("app") that runs on a mobile device operable by the user for remote setting ("remote control") of program parameters.

In some embodiments, the smart tub and intelligent valve plumbing system comprises a smart water basin ("tub"), a faucet, a printed circuit board (PCB) control unit ("PCB controller") with embedded smart tub and intelligent valve control software (also referred to as the "embedded smart tub and intelligent valve firmware"), a housing that encapsulates the PCB controller, a cold water handle connected to a cold water source hose, a hot water handle connected to a hot water source hose, an intelligent water control valve ("intelligent valve" or "intel valve") that is configured to adjust a volume of cold water released through the cold water source hose and a volume of hot water released through the hot water source hose, a plurality of solution dispensers, a runoff drain, and a drain sensor within the runoff drain. In some embodiments, the faucet is configured to release temperature-adjusted water into the tub until the drain sensor detects water flow out of the tub through the runoff drain. In some embodiments, the plurality of solution dispensers are configured to release solution into the tub as the faucet fills the tub with temperature-adjusted water.

In some embodiments, the PCB controller comprises a wireless communications module. In some embodiments, a control panel is communicably connected to the PCB controller and exposed along an external surface of the housing. In some embodiments, the program parameters comprise a water temperature setting, a solution mixture setting, a solution timer setting, and a schedule day and time setting at which a tub of water should be filled at the set temperature and with the solution mixture added to the water. In some embodiments, the control panel enables a user to manually control the water temperature setting, the solution mixture setting, the solution timer setting, and the schedule day and time setting.

In some embodiments, the wireless communications module is configured to receive wireless commands transmitted by the mobile app via Wifi, Bluetooth, or any other wireless transmission protocol. In some embodiments, the wireless communications module passes the received commands to the PCB controller. In some embodiments, the PCB controller automatically triggers the faucet to release water into the tub. In some embodiments, the PCB controller automatically triggers the intelligent valve to adjust a volume of hot water to release from the hot water source hose connected to the hot water handle and the volume of cold water to release from the cold water source hose connected to the cold water handle. In some embodiments, the mobile app includes a user interface that is configured for user interaction to set the program parameters and wirelessly operate the smart tub and intelligent valve plumbing system.

In some embodiments, manually controlling the intelligent valve on site, via the control panel, overrides wireless functioning at the moment of manual manipulation. In some embodiments, the smart tub includes connected hot and cold water hoses which allow the smart tub and intelligent valve plumbing system to set the temperature of the water as desired. Furthermore, the smart tub and intelligent valve plumbing system of some embodiments controls the time of filling the tub and the time of releasing the tub's solution dispenser, which is a battery-operated dispenser configured to release an amount of solution into the water. In particular, the battery-operated dispenser is configured to release only the desired amount of solution into the water. In some embodiments, the battery-operated dispenser automatically detects a safe amount of solution to dispense so as not to overflow the tub when released into the water.

In some embodiments, the **** further comprises a power cable that connects to an external power source, such as a wall outlet, and provides electrical power to the electronic components, such as the PCB controller and sensors. In some embodiments, the ** further comprises a backup battery that provides electrical power to the electronic components when the power source is interrupted or disconnected.

In some embodiments, the control panel of the smart tub and intelligent valve plumbing system further comprises a touchscreen display that is configured to visually output information, such as water temperature, solution mixture ratios, day and time scheduled settings, etc. In some embodiments, the touchscreen display is further configured for user interaction to set program parameters to control the schedule day and time, or set other parameters to control the smart tub and intelligent valve plumbing system.

In some embodiments, the smart tub and intelligent valve plumbing system further comprises a draining hose out the bottom drain of the smart tub. In some embodiments, the smart tub and intelligent valve plumbing system further comprises a bottom tub drain sensor at, near, or within the bottom drain.

In some embodiments, the smart tub and intelligent valve plumbing system further comprises a heating element that is configured to underlay the bottom of the tube to provide an external heating element to maintain the desired temperature of the water filled in the tub as long as the user wishes.

In some embodiments, the smart tub and intelligent valve plumbing system further comprises a timer with safety sensors. In some embodiments, the safety sensors comprise a heat sensor, a water level/overflow protection sensor placed at, near, or within the runoff drain of tub, a walk-in tub door sensor configured to detect when the door of the walk-in tub is not fully closed and water-tight sealed, and a haptic feedback sensor configured to detect a slip-and-fall events, such as detected by impact of a user, such as an elderly person who slips in the tub). In some embodiments, the haptic feedback sensor is configured to detect slip-and-fall events and trigger the embedded smart tub and intelligent valve control software running on the PCB controller to automatically drain the tub via a bottom drain. In some embodiments, the bottom tub drain sensor is configured to detect when water is flowing through the bottom drain. In this way, the smart tub and intelligent valve plumbing system detects leaks and also detects when all water in the tub is released after a slip-and-fall event triggered an automatic draining of the tub.

In some embodiments, the smart tub and intelligent valve plumbing system further comprises an audible alarm system that is configured to automatically trigger one or more audible alarms to sound an alarm through one or more speakers communicably connected to the PCB controller. In some embodiments, the alarm is triggered when an emergency situation is detected, such as a slip-and-fall event, a user submerged under water for longer than a threshold time span considered unsafe, or a user overheating in the tub. In some embodiments, at least one speaker is an embedded of the control panel and is automatically triggered by the embedded smart tub and intelligent valve control software running on the processing unit of the PCB controller when haptic sensor detects a slip-and-fall impact against the tub, or another unsafe situation with respect to the user of the smart tub and intelligent valve plumbing system.

In some embodiments, the smart tub and intelligent valve plumbing system further comprises a visual alarm system that is configured to automatically flash a visual alarm when an emergency situation is detected. In some embodiments, one or both of the audible alarm and the visual alarm are communicably connected to the PCB controller by a wired or wirelessly connection to another room that is different from a room in which the smart tub is located.

Embodiments of the smart tub and intelligent valve plumbing system described in this specification differ from and improve upon currently existing options. In particular, existing tubs have manual dials for hot and cold water, so a person needs to manually controls the dials to fill the tub with water, set the temperature, and add bath solutions as desired. By contrast, the smart tub and intelligent valve plumbing system of the present disclosure is fully automatic and is able to be controlled wirelessly from a remote location. Additionally, the smart tub and intelligent valve plumbing system is safe, being a child and senior-friendly device that will not cause overflowing water out of the tub, or excessively hot/cold water, or releasing an unsafe amount of bath solution.

The smart tub and intelligent valve plumbing system of the present disclosure may be comprised of the following elements. This list of possible constituent elements is intended to be exemplary only and it is not intended that this list be used to limit the smart tub and intelligent valve plumbing system of the present application to just these elements. Persons having ordinary skill in the art relevant to the present disclosure may understand there to be equivalent elements that may be substituted within the present disclosure without changing the essential function or operation of the smart tub and intelligent valve plumbing system.

1. An intelligent valve
2. Hose(s)
3. Controller and related control panel/software (mobile app)
4. Solution dispensers
5. Runoff drain sensor The various elements of the smart tub and intelligent valve plumbing system of the present disclosure may be related in the following exemplary fashion. It is not intended to limit the scope or nature of the relationships between the various elements and the following examples are presented as illustrative examples only. The intelligent valve (item #1) controls the tub filling process. The hoses (item #2) connect to hot and cold water release valves of the house. The software/mobile app (item #3) sets the timing and controls of operation of the intelligent valve. The solution dispenser (item #4) is used to dispense measured amounts of liquids/bath solutions into the water in the tub.

Figure 2:
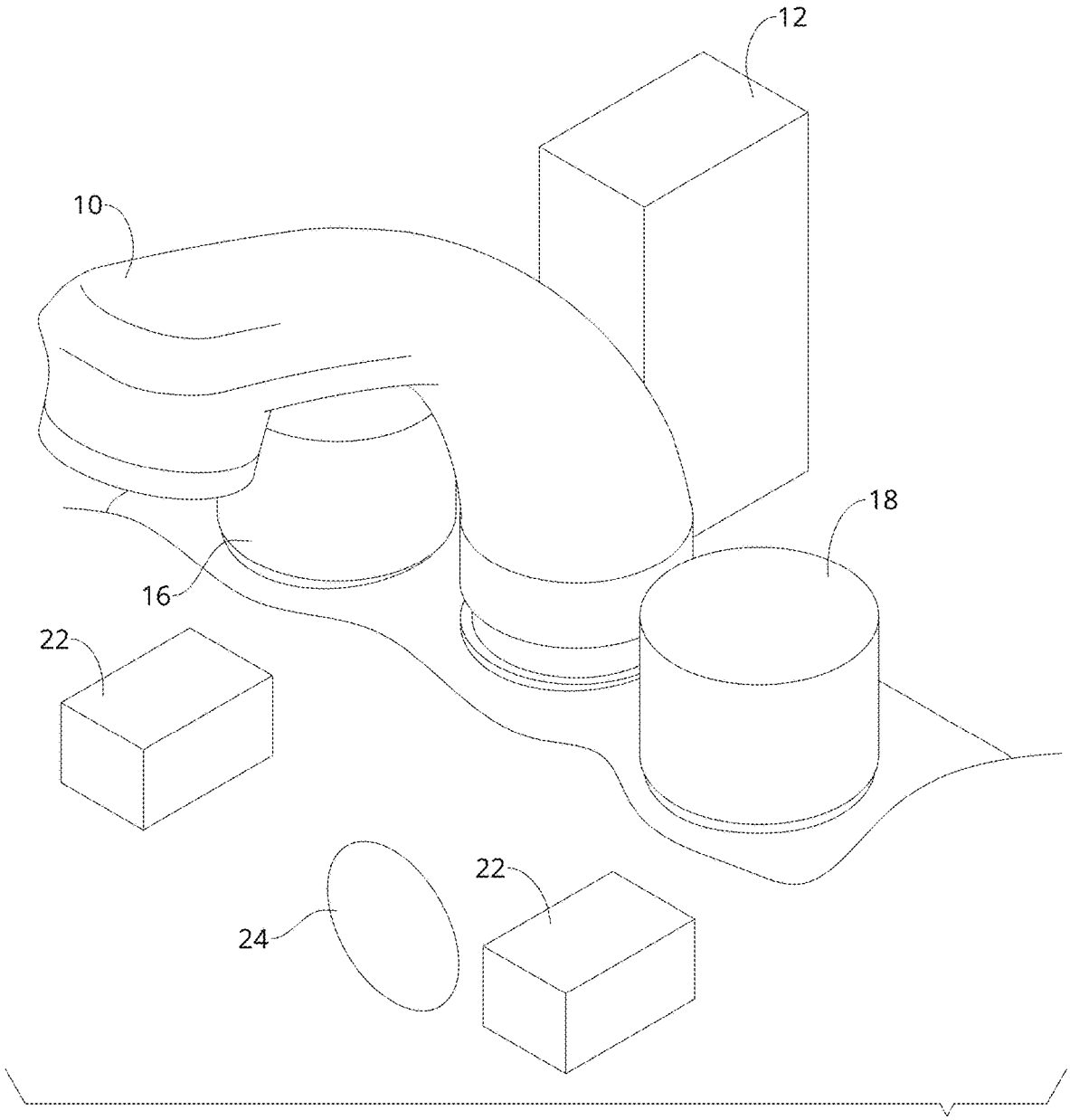
FIG. 2 conceptually illustrates a perspective view of the smart tub and intelligent valve plumbing system plumbing system in some embodiments.

By way of example, FIGS. 1-2 conceptually illustrates a smart tub and intelligent valve plumbing system in some embodiments. As shown in these figure, the smart tub and intelligent valve plumbing system comprises a faucet 10, a housing 12, a PCB controller 14, a cold water handle 16 connected to a cold water source hose, a hot water handle 18 connected to a hot water source hose, an intelligent valve 20 that is configured to adjust a volume of cold water released through the cold water source hose and a volume of hot water released through the hot water source hose, a plurality of solution dispensers 22, a runoff drain 24, a drain sensor 26 within the runoff drain 24, and a tub 28 in which the temperature-adjusted water is filled and the solution is dispensed.

In some embodiments, the intelligent value 20 is configured to adjust a volume of cold water released via cold water handle 16 through the cold water source hose and a volume of hot water released via hot water handle 18 through the hot water source hose.

In some embodiments, the PCB controller 14 is a motherboard comprising a processing unit, a memory, and the wireless communications module. An example of a controller 14 is described further below, by reference to FIG. 3.

In some embodiments, the housing 12 encapsulates the PCB controller 14 to shield the electronics of the PCB controller 14 from water and external elements in the environment.

The smart tub and intelligent valve plumbing system of the present disclosure generally works by releasing water out of the faucet 10 into the tub 28 to fill the tub to its natural level of capacity. The natural level of capacity is either programmed to a preset volume (via control panel or remotely) or is determined dynamically by the drain sensor 26 which is configured to detect water flow out of the tub 28 and into the runoff drain 24. When the drain sensor 26 detects water runoff flow through the runoff drain 26, the sensor data is sent (as a signal) to the PCB controller 14. The PCB controller 14, in turn, receives the signal from the drain sensor 26 and automatically triggers the intelligent valve 20 to stop the water flow out of the faucet 10. This is done by closing off the water source hose connections to the faucet 10. Since the hoses are connected for hot and cold use, the intelligent valve 20 is also configured to adjust the volume of hot water and cold water being released through each according to the temperature setting desired. Thus, the intelligent valve 20 can adjust the flow of hot and cold water to obtain a temperature-adjusted mixture in precise proportions to achieve the particular desired temperature. What is meant by 'desired temperature' is the temperature preferred by the user, as set by the user manually through the control panel and set to a schedule (day and time) or set remotely, via the mobile app. The mobile app would be run on the mobile device of the user, but would connect wirelessly to the wireless communications module of the PCB controller 14. This may require a network connection, such as one through WiFi or Bluetooth, with access to the Internet. In this way, the user can use the mobile app to control the temperature of the water being filled in the tub 28 prior to arriving home from work or another location. Furthermore, the user can interact with the mobile app to set the time at which the intelligent valve fills the tub with water and releases the solution from the dispenser, overriding any existing schedule for the day with the new time setting. Additionally, the plurality of solution dispensers 22 are battery-operated and, therefore, are configured to release a desired and safe amount of solution in the time frame at which the user is expected to have a bath. Furthermore, the solution is dispensed in an intelligent manner, such that it is timed with the filling of the tub 28 with water, so as to not overflow the tub 28 with bubbles from the solution, and also in a way that would not overwhelm the user with too much solution, thereby making the dispensing of solution into the tub 28 safe for the user or any bather.

To make the smart tub and intelligent valve plumbing system of the present disclosure, one would design an intelligent valve to fit on any tub that can connect to hot and cold hose. Making the smart tub and intelligent valve plumbing system is not limited to the intel value itself, since one would also need to design, develop (code), and build the software to function as a controller of the intel value and dispenser. The software can be designed as any kind of software, but a mobile app implementation is a preferred type of software. The software would run on a device (e.g., a mobile device) that is capable of WiFi, Bluetooth, and other wireless communications to wirelessly control the operational use of the smart tub and intelligent valve plumbing system. The dispenser would be designed to be battery operated and configured to connect to the tub for easy release of liquids/solution into the tub.

To use the smart tub and intelligent valve plumbing system of the present disclosure, a person would install on an existing bathtub and then set up preferred time, temperature, etc., through the mobile app. In this way, the person would be able to control the filling of the bathtub by the level of water and temperature, and the amount of bath wash or other solution if wanted. The person could also do some or all such things manually.

In this specification, the terms "mobile application", "mobile app", "software", "program", and variations of these terms (collective referred to as "software") are meant to include applications stored in magnetic storage, which can be read into memory for processing by a processor, such as the processing unit of the PCB controller 14, described above by reference to FIGS. 1-2. In some embodiments, the software, when installed to operate on one or more electronic systems, such as the PCB controller 14, define one or more specific machine implementations that execute and perform the operations of the software, whether programmed scheduling or manual operation via the control panel or remotely via mobile app. In particular, the processes described above may be implemented as software processes that are specified as a set of instructions recorded on a computer readable storage medium (also referred to as a non-transitory computer readable medium). When these instructions are executed by one or more processing unit(s), they cause the processing unit(s) to perform the actions indicated in the instructions, such a triggering the intelligent valve 20 to adjust the temperature of water being released out of the faucet 10 into the tub 28 or triggering the solution dispensers to safely release solution into the water in the tub 28 at the right time. Examples of computer readable media include, but are not limited to, flash drives, RAM chips, hard drives, EPROMs, EEPROMs, etc. The computer readable media does not include carrier waves and electronic signals passing wirelessly or over wired connections.

Figure 3:
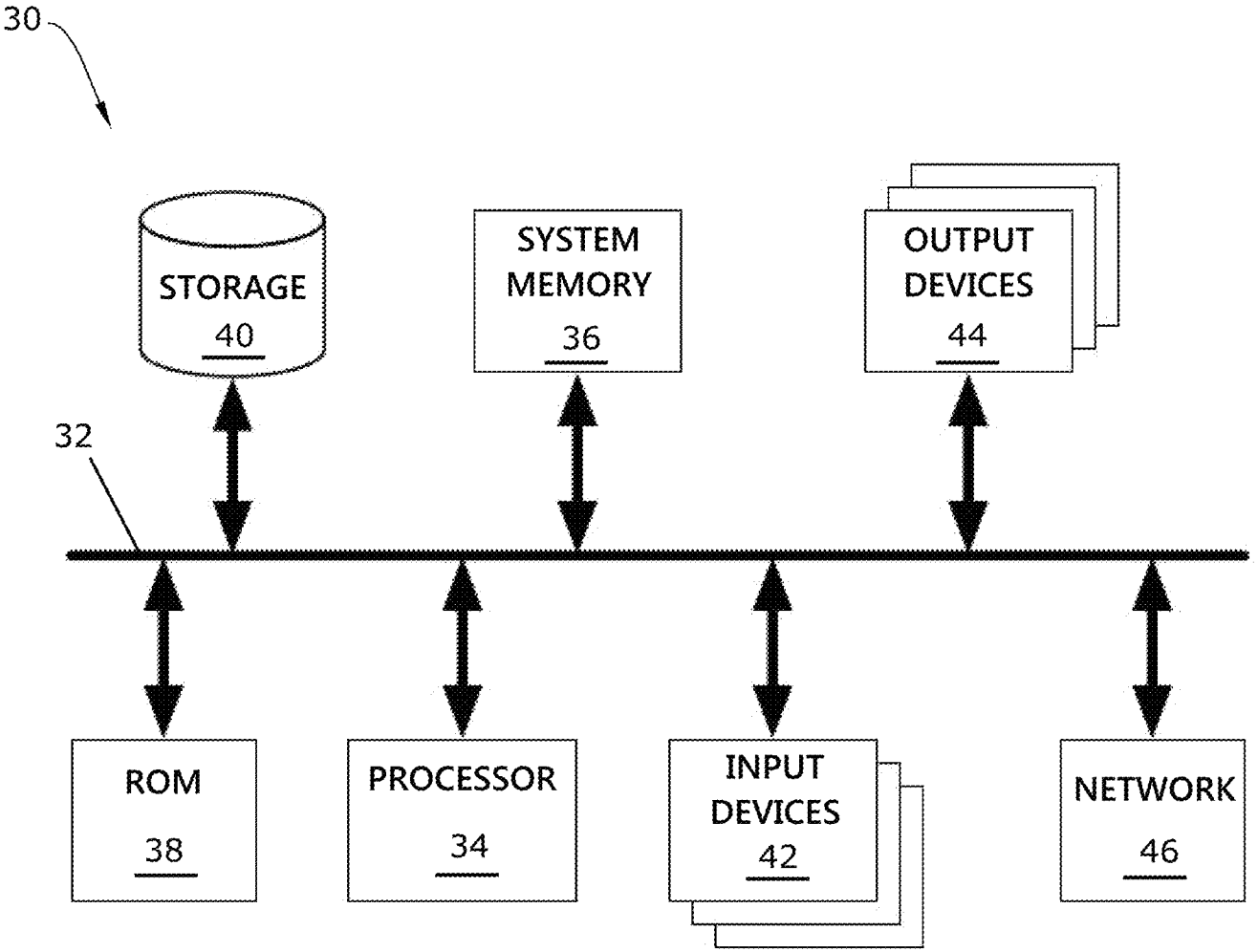
FIG. 3 illustrates an electronic system with which some embodiments of the invention are implemented.

By way of example, FIG. 3 illustrates an electronic system 30. The electronic system 30 may be any computing device, but in connection with the smart tub and intelligent valve plumbing system described above, by reference to FIGS. 1-2, is the PCB controller 14. However, the PCB controller 14 could be substituted with another type of electronic controller system or computing device, such as a single board computer (SBC) or other electronic device capable of processing programmed instructions and triggering the various components of the smart tub and intelligent valve plumbing system. In addition to the wireless communications module described above, the electronic system 30 (or PCB controller 14) includes various types of computer readable media and interfaces for various other types of computer readable media. In some embodiments, the electronic system 30 includes a bus 32, processing unit(s) 34, a system memory 36, a read-only memory (ROM) 38, a permanent storage device 40, input devices 42 (such as the control panel), output devices 44 (such as a display screen), and a network 340.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

I claim:

1. A smart tub and intelligent valve plumbing system that enables remote filling and temperature control of a water basin, said smart tub and intelligent valve plumbing system comprising:

an intelligent water control valve ("intel valve") disposed within a faucet of the water basin and configured to automatically fill the water basin with temperature-adjusted water by mixing a first volume of cold water received through a cold water hose and a second volume of hot water received through a hot water hose to produce temperature-adjusted water based on a temperature specified by a user, wherein the temperature-adjusted water is released from the faucet into the water basin until the water basin reaches a capacity level;

a mobile app installed on a mobile device operable by the user, wherein the mobile app wirelessly transmits a command to the intel valve to initiate filling of the water basin at a time specified by the user;

a runoff drain formed in the water basin;

a drain sensor disposed within the runoff drain and configured to detect water exiting the water basin through the runoff drain after the water basin has reached the capacity level, and to generate runoff-flow sensor data corresponding to the detected exiting water;

a printed circuit board (PCB) controller comprising a control panel for manual operation and a wireless communications module for wireless operation, wherein the wireless communications module is configured to (i) receive wireless commands directly from the mobile app and (ii) provide the received wireless commands to the PCB controller to control operation of the intel valve, and wherein the PCB controller is communicably connected to the drain sensor and is configured to (iii) receive, from the drain sensor, a runoff-flow signal comprising the runoff-flow sensor data indicating that water is exiting the water basin through the runoff drain after the capacity level has been reached, and (iv) automatically terminate release of the water from the intel valve in response to receiving the runoff-flow signal;

a solution dispenser configured to dispense a liquid solution into the water basin while the intel valve is releasing water into the water basin; and a battery configured to power the solution dispenser.

2. The smart tub and intelligent valve plumbing system of claim 1, wherein the runoff drain is positioned at an overflow elevation of the corresponding to the capacity level.

3. The smart tub and intelligent valve plumbing system of claim 2, wherein the drain sensor is positioned within an overflow flow path of the runoff drain such that the drain sensor detects water only after the water basin reaches the capacity level.

4. The smart tub and intelligent valve plumbing system of claim 1, wherein the PCB controller is configured to terminate release of water from the intel valve only in response to detection of water exiting through the runoff drain.

5. The smart tub and intelligent valve plumbing system of claim 1 further comprising a controller housing.

6. The smart tub and intelligent valve plumbing system of claim 5, wherein the PCB controller is encapsulated within the controller housing.

7. The smart tub and intelligent valve plumbing system of claim 1, wherein the temperature specified by the user comprises a preferred temperature set by the user via the control panel or the mobile application.

8. The smart tub and intelligent valve plumbing system of claim 1, wherein the PCB controller further comprises a processing unit and a memory storing executable control instructions for controlling operation of the intel valve based on the runoff-flow signal.

9. The smart tub and intelligent valve plumbing system of claim 1, wherein the level is programmable to a preset volume via the control panel or the mobile app.

10. The smart tub and intelligent valve plumbing system of claim 1, wherein the capacity level corresponds to a physical overflow elevation of the runoff drain.

11. The smart tub and intelligent valve plumbing system of claim 1, wherein the wireless communications module is configured to receive the wireless commands directly from the mobile application without an intermediate remote server.

12. The smart tub and intelligent valve plumbing system of claim 1, wherein the solution dispenser is configured to dispense the liquid solution during filling of the water basin and prior to automatic termination of water release by the PCB controller.

13. The smart tub and intelligent valve plumbing system of claim 1, wherein the drain sensor comprises a flow sensor configured to detect directional water flow exiting the water basin through the runoff drain.

14. The smart tub and intelligent valve plumbing system of claim 1, wherein the PCB controller is configured to prevent further filling of the water basin until the runoff-flow signal is no longer detected.

* * * * *